US011660771B2

(12) United States Patent
Oudsen

(10) Patent No.: US 11,660,771 B2
(45) Date of Patent: May 30, 2023

(54) CUTTING DEVICE AND METHOD FOR CUTTING PAPER

(71) Applicant: SDD HOLDING B.V., Emst (NL)

(72) Inventor: Johannes Franciscus Roland Oudsen, Emst (NL)

(73) Assignee: SDD HOLDING B.V., Emst (NL)

( * ) Notice: Subject to any disclaimer, the term of this patent is extended or adjusted under 35 U.S.C. 154(b) by 0 days.

(21) Appl. No.: 17/269,361

(22) PCT Filed: Aug. 16, 2019

(86) PCT No.: PCT/NL2019/050535
§ 371 (c)(1),
(2) Date: Feb. 18, 2021

(87) PCT Pub. No.: WO2020/046113
PCT Pub. Date: Mar. 5, 2020

(65) Prior Publication Data

US 2021/0308891 A1 Oct. 7, 2021

(30) Foreign Application Priority Data

Aug. 30, 2018 (NL) ..... 2021522

(51) Int. Cl.
*B26D 1/08* (2006.01)
*B26D 5/08* (2006.01)
(Continued)

(52) U.S. Cl.
CPC ..... *B26D 1/085* (2013.01); *B26D 5/086* (2013.01); *B26D 7/0006* (2013.01); *B26D 7/2614* (2013.01)

(58) Field of Classification Search
CPC .. B26D 1/08; B26D 1/085; B26D 2007/0018; B26D 2007/322; B26D 5/14; B26D 5/16;
(Continued)

(56) References Cited

U.S. PATENT DOCUMENTS 1,119,610 A * 12/1914 Johnson ..... B02C 1/14 83/613
2,869,177 A * 1/1959 Jurgeleit ..... F16C 29/02 425/234
(Continued)

OTHER PUBLICATIONS

Search Report and Written Opinion from corresponding Dutch Application No. NL2021522, dated May 10, 2019.
(Continued)

*Primary Examiner* — Jonathan G Riley
(74) *Attorney, Agent, or Firm* — Workman Nydegger P.C.

(57) ABSTRACT

A cutting device and a method for cutting paper are provided. The cutting device includes a cutting blade and a counter-member. The cutting device is further provided with a first guide and a second guide extending in or parallel to the driving direction for linearly guiding a holder that holds the cutting blade. Each of the guides includes a guide body. The guide bodies of the first guide and the second guide, when released, are arranged to be rotatable relative to the frame about a first adjustment axis and a second adjustment axis, respectively. Each guide body includes an eccentric section that moves eccentrically about the respective adjustment axis and that is arranged to convert the rotational movement of the guides about the respective adjustment axes into a linear movement of the holder in the adjustment direction.

20 Claims, 11 Drawing Sheets

(51) Int. Cl.
*B26D 7/00* (2006.01)
*B26D 7/26* (2006.01)

(58) Field of Classification Search
CPC ..... B26D 7/025; B26D 7/18; B26D 7/1818; B26D 5/086; B26D 7/0006; B26D 7/2614; B21D 37/10; B21D 37/12; B30B 15/041; F16C 2322/14; F16C 29/02; F16C 35/02; Y10T 83/2096; Y10T 83/2198; Y10T 83/222; Y10T 83/7533; Y10T 83/8821; Y10T 83/9493; Y10T 83/8878; Y10T 83/051; Y10T 83/647; Y10T 83/6577
See application file for complete search history.

(56) References Cited

U.S. PATENT DOCUMENTS 3,046,825 A * 7/1962 Thompson ..... B23D 35/002 100/98 R
3,174,375 A * 3/1965 Westra ..... B26D 1/08 83/626
3,238,824 A * 3/1966 Jallo ..... B65H 29/00 83/156
3,757,621 A * 9/1973 Breetvelt ..... B23D 15/04 83/157
2004/0159316 A1* 8/2004 Muller ..... B28D 5/0082 125/16.02
2008/0041203 A1* 2/2008 Regterschot ..... B26D 1/08 83/13
2009/0007746 A1* 1/2009 Gunn ..... B26D 1/08 83/558
2009/0165625 A1* 7/2009 Ishii ..... B26D 7/025 270/58.08
2013/0276609 A1* 10/2013 Hatakeyama ..... B26D 7/08 83/582
2015/0020662 A1* 1/2015 Yamada ..... B26D 7/1818 83/167
2016/0199900 A1* 7/2016 Schreck ..... F16C 29/002 72/456
2018/0065267 A1* 3/2018 Lin ..... B26D 1/085

OTHER PUBLICATIONS

International Search Report and Written Opinion from PCT Application No. PCT/NL2019/050535, dated Dec. 20, 2019.

* cited by examiner

CUTTING DEVICE AND METHOD FOR CUTTING PAPER

BACKGROUND

The invention relates to a cutting device and a method for cutting paper.

Known cutting devices, in particular guillotine cutting devices for document finishing lines in the digital printing market, are provided with a cutting blade and a counter-blade that have to be calibrated extremely accurately to ensure consistent and complete cutting. For this purpose, the frame that holds the cutting blade and the counter-blade is designed to be as rigid as possible and the positions of both the cutting blade and the counter-blade can be adjusted relative to the frame by means of a plurality of spacers and corresponding fasteners.

SUMMARY OF THE INVENTION

A disadvantage of the known cutting devices is that each spacer has to be adjusted and fastened individually. This requires a lot of specialized knowledge, which is why the initial calibration is usually performed by a trained calibration technician. However, even for a trained calibration technician, calibration takes at least thirty minutes. However, after the initial calibration, any further calibrations are performed in the field by a technician with less experience. Such further calibrations may take considerably longer.

It is an object of the present invention to provide a cutting device and method for cutting paper, wherein the ease of calibration of the cutting device can be improved.

According to a first aspect, the invention provides a cutting device for cutting paper, wherein the cutting device comprises a cutting blade and a counter-member that cooperate to cut the paper along a cutting line, wherein the cutting device comprises a frame and wherein the cutting blade is movable relative to said frame towards and away from the counter-member in a driving direction, transverse or perpendicular to the cutting line, for cutting the paper, wherein the cutting device comprises a holder for holding the cutting blade relative to the counter-member, wherein the cutting device is further provided with a first guide and a second guide extending in or parallel to the driving direction for linearly guiding the holder, wherein the cutting device comprises one or more first fixation members for fixating at least the first guide relative to the frame, wherein the one or more first fixation members are arranged for releasing the fixation of the first guide relative to the frame, wherein the first guide, when released, is movable relative to the frame in an adjustment direction perpendicular to the cutting line and the driving direction, wherein each of the guides comprises a guide body, wherein the guide bodies of the first guide and the second guide, when released, are arranged to be rotatable relative to the frame about a first adjustment axis and a second adjustment axis, respectively, wherein each guide body comprises an eccentric section that moves eccentrically about the respective adjustment axis and that is arranged to convert the rotational movement of the guides about the respective adjustment axes into a linear movement of the holder in the adjustment direction.

Hence, a simple rotation of the guides about their respective adjustment axes can effectively cause a linear displacement of the holder in the adjustment direction, without the need of additional mechanical components.

By moving the first guide in the adjustment direction, the linear path along which the holder is guided can be adjusted.

Consequently, the position of the cutting blade relative to the counter-member can be easily adjusted. Moreover, since the first guide is adjusted relative to the frame rather than the cutting blade relative to the holder, the cutting blade can be fixed securely to said holder, thereby significantly reducing the complexity of the calibration and/or reducing tolerances.

Preferably, the one or more first fixation members are arranged for releasing the fixation of the second guide relative to the frame, wherein the second guide, when released, is movable relative to the frame in the adjustment direction. By moving the first guide and the second guide in the adjustment direction, not only the position but also the orientation of the cutting blade relative to the counter-member in the adjustment direction can be adjusted. More in particular, when the counter-member is a counter-blade, it is possible to position the cutting blade such that at least one end thereof slightly overlaps with the counter-blade, i.e. at a negative tolerance, to obtain a scissor-like bias or tension between the cutting blade and the counter-blade.

In a further embodiment the holder is arranged to slide over or along the first guide and the second guide in the driving direction. The holder can thus be moved with respect to the guides while the guides are adjusted in the adjustment direction.

In a further embodiment the holder is provided with slotted holes through which the eccentric sections of the respective guides are received, wherein the slotted holes are elongated in a lateral direction perpendicular to the driving direction and the adjustment direction to absorb the eccentric movement of the eccentric sections relative to the holder in the lateral direction and to follow the eccentric movement of the eccentric sections in the adjustment direction. Consequently, the holder will only move in the adjustment direction and cancel out the component of the eccentric movement in the lateral direction. The holder can therefore remain in place in the lateral direction to maintain the cutting blade in proper alignment above the counter-member.

In a further embodiment thereof the eccentric sections of the first guide and the second guide have varying radii with respect to the first adjustment axis and the second adjust axis respectively, wherein the radii vary within a maximum adjustment range of at least half a millimeter, preferably at least one millimeter and most preferably at least two millimeters. The maximum adjustment range defines the maximum distance over which eccentric sections can displace the holder in the adjustment direction. The specified range should be sufficient to calibrate the cutting device properly.

In a further embodiment thereof each guide is provided with one or more tool engagement elements to facilitate engagement of the guide with a tool for rotating the guide about the respective adjustment axis. Preferably, the one or more tool engagement elements are tool holes for receiving a lever that facilitates manual rotation of the guides. A tool may be used to securely engage the guides and to allow for accurate and/or fine adjustment of the guides relative to the frame. In the embodiment of the tool holes, a tool such as a lever can be easily inserted into one of the tool holes to manually adjust the guides.

In a practical embodiment thereof each guide comprises two or more tool engagement elements which are offset in a circumferential direction about the guide body. The offset provides the calibration technician with multiple options to engage the guide and allows for switching between tool engagement elements, in particular, when one of the tool engagement elements is out of reach.

In a further embodiment each guide comprises a reference element that indicates a special position of the respective guide. The special position may be a starting position, a default position or an optimal position.

In another embodiment the one or more first fixation members are located at a top end of the frame, wherein the guides are fixed to a lower end of the frame by fasteners, wherein the fasteners are fixated against rotation relative to the frame about the respective adjustment axis by the tension of a spring acting in a tension direction parallel to the driving direction, wherein the cutting device is provided with a clearance between the guide bodies and the lower end of the frame to allow the guide bodies to move in the tension direction when released by the one or more first fixation members at the top end.

In another embodiment the one or more first fixation members comprises a bolt, preferably a bolt with a hexagonal socket. The bolt can be used to clampingly fixate the guide relative to the frame, while functioning as bearing for rotation of the guide about the respective adjustment axis when released.

In another embodiment the cutting device is provided with a drive mechanism to drive the movement of the cutting blade with respect to the counter-member in the driving direction, wherein the drive mechanism comprises a first linear actuator and a second linear actuator which are arranged to act on the holder in or parallel to the driving direction. The linear actuators can reliably drive the holder and the cutting blade attached thereto in the driving direction while the guides guide the holder in said driving direction.

In an embodiment thereof the cutting device comprises one or more second fixation members for fixating the holder to the linearly moving parts of the linear actuators, wherein the one or more second fixation members are arranged for releasing the holder from said fixation, wherein the holder, when released, is movable relative to the linear actuators in the adjustment direction. The holder can now be moved together with the guides in the adjustment direction. The holder can be fixated again after the calibration has been completed.

In a further embodiment thereof each linear actuator comprises a rotatable screw and a nut that is arranged to travel linearly along the screw, wherein the one or more second fixation members are arranged for fixating the holder to and releasing the holder from the nuts of the linear actuators. The rotatable screw and the nut together form a spindle. The holder can be released from the nuts to allow for calibration at the guides, while the same nuts can be fixated again to the holder after the calibration has been completed.

In a further embodiment thereof the holder is movable with respect to the linear actuators in the adjustment direction within a maximum adjustment range of at least half a millimeter, preferably at least one millimeter and most preferably at least two millimeters. In other words, a tolerance or gap is provided between the linear actuators and the holder to allow for the calibration at the guides when the holder is released from the linear actuators.

Additionally or alternatively, the cutting blade comprises a flat or substantially flat cutting surface, wherein the driving direction is parallel or substantially parallel to said flat cutting surface.

According to a second aspect, the invention provides a method for cutting paper with the use of the cutting device according to any one of the aforementioned embodiments, wherein the method comprises a calibration of the cutting blade with respect to the counter-member, wherein the calibration comprises the steps of using the one or more first fixation members to release the fixation of the first guide relative to the frame and moving the first guide relative to the frame in the adjustment direction.

The method relates to the practical use of the previously discussed cutting device. Consequently, the method and its embodiments have the same technical advantages as the aforementioned cutting device and its respective embodiments. These advantages will not be repeated hereafter.

Preferably, the calibration further comprises the steps of using the one or more first fixation members to release the fixation of the second guide relative to the frame and moving the second guide relative to the frame in the adjustment direction.

In a further embodiment the first guide and/or the second guide are moved over small increments, wherein the calibration further comprises the step of performing a cutting stroke between the increments to check if the paper is being cut. Hence, the cutting blade may be progressively calibrated relative to the counter-member to prevent excessive adjustment that could lead to jamming, malfunction or even damage to the cutting device.

In an embodiment thereof the cutting blade is initially calibrated by cutting and checking the cut in a single sheet of paper, wherein, when the calibration based on the single sheet of paper has been completed, the calibration further comprises the step of cutting a stack of paper and then again cutting a single sheet of paper. The stack of paper may cause some deburring at the cutting edges that may have a negative impact on the cutting quality. After the stack of paper has been cut successfully, the calibration technician again cuts a single sheet of paper to see if said single sheet of paper is still cut consistently. If not, the abovementioned calibration steps can be repeated.

Additionally or alternatively, the cutting blade comprises a flat or substantially flat cutting surface, wherein the driving direction is parallel or substantially parallel to said flat cutting surface.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached schematic drawings, in which.

DETAILED DESCRIPTION OF THE INVENTION

FIGS. 1-6 show a cutting device 1 according to a first exemplary embodiment of the invention. The cutting device 1 is arranged for shearing, trimming or cutting paper 9, in particular stacks of paper or booklets 90, for example in a document finishing line for the digital printing market. A document finishing line may comprise one or more of the cutting devices 1, i.e. to enable one-side, two-side or three-side trimming.

Figure 1:
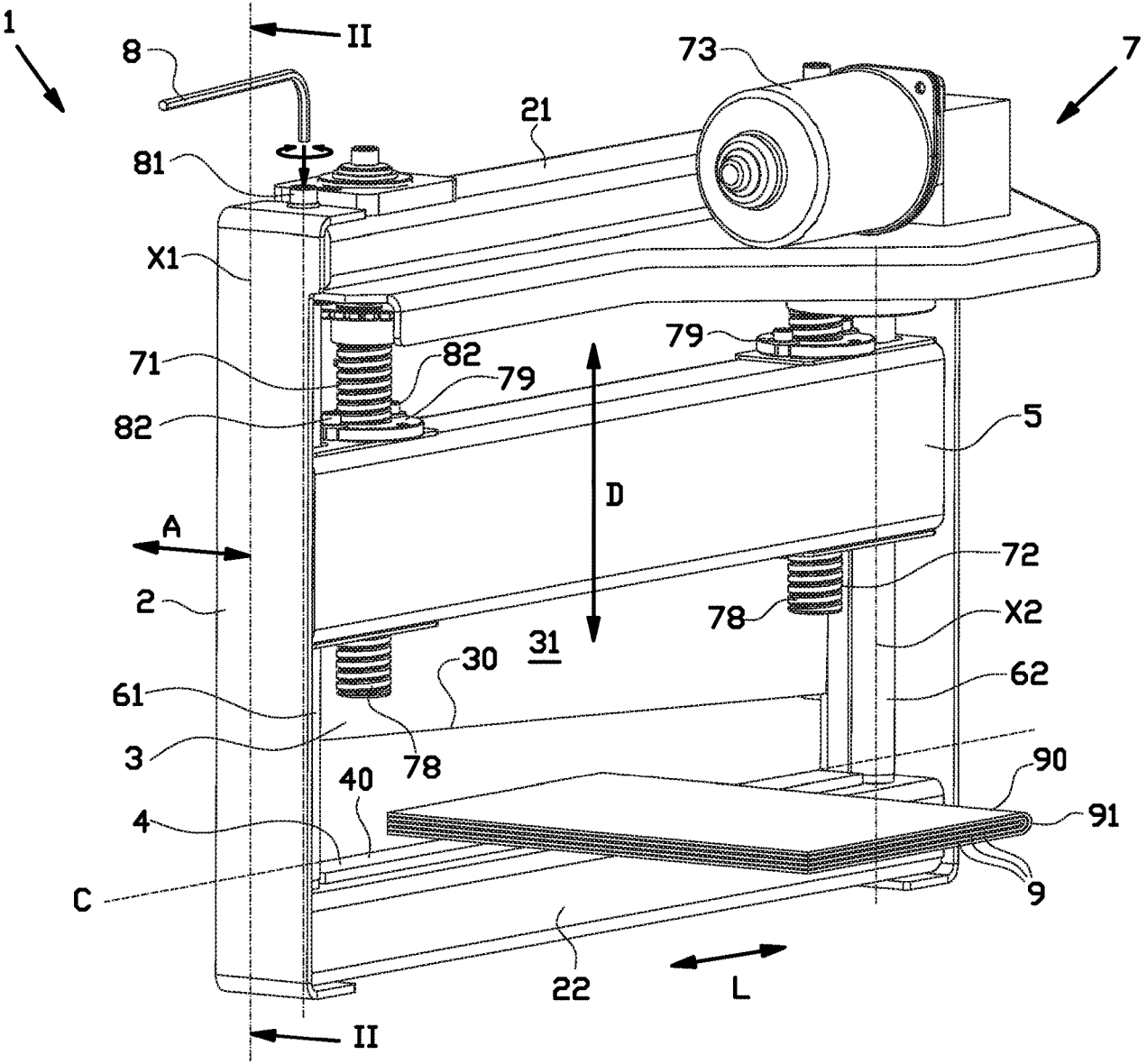
FIG. 1 shows an isometric view of a cutting device for cutting paper according to a first embodiment of the invention.

As shown in FIG. 1, the cutting device 1 comprises a housing or a frame 2 and a knife or a cutting blade 3 that is movably supported with respect to said frame 2 for cutting along a cutting line C. The cutting device 1 further comprises a counter-member in the form of a counter-knife or counter-blade 4 that is arranged in a stationary position at or along the cutting line C to cooperate with the movable cutting blade 3 to cut the paper 9. In this exemplary embodiment, the counter-knife 4 is mounted to the frame 2.

The cutting device 1 according to the first exemplary embodiment of the invention operates as a guillotine cutter. As such, the cutting blade 3 is movable in a driving direction D perpendicular to the cutting line C towards and away from the counter-blade 4 for cutting the paper 9. In this exemplary embodiment, the driving direction D is vertical or substantially vertical. Hence, the cutting blade 3 is movable in a vertically downward cutting stroke and a vertically upward return stroke. The cutting blade 3 is angled at an oblique angle to the cutting line C to progressively cut the paper 9 along the cutting line C. In contrast, the counter-blade 4 extends parallel or substantially parallel to the cutting line C.

Figure 6:
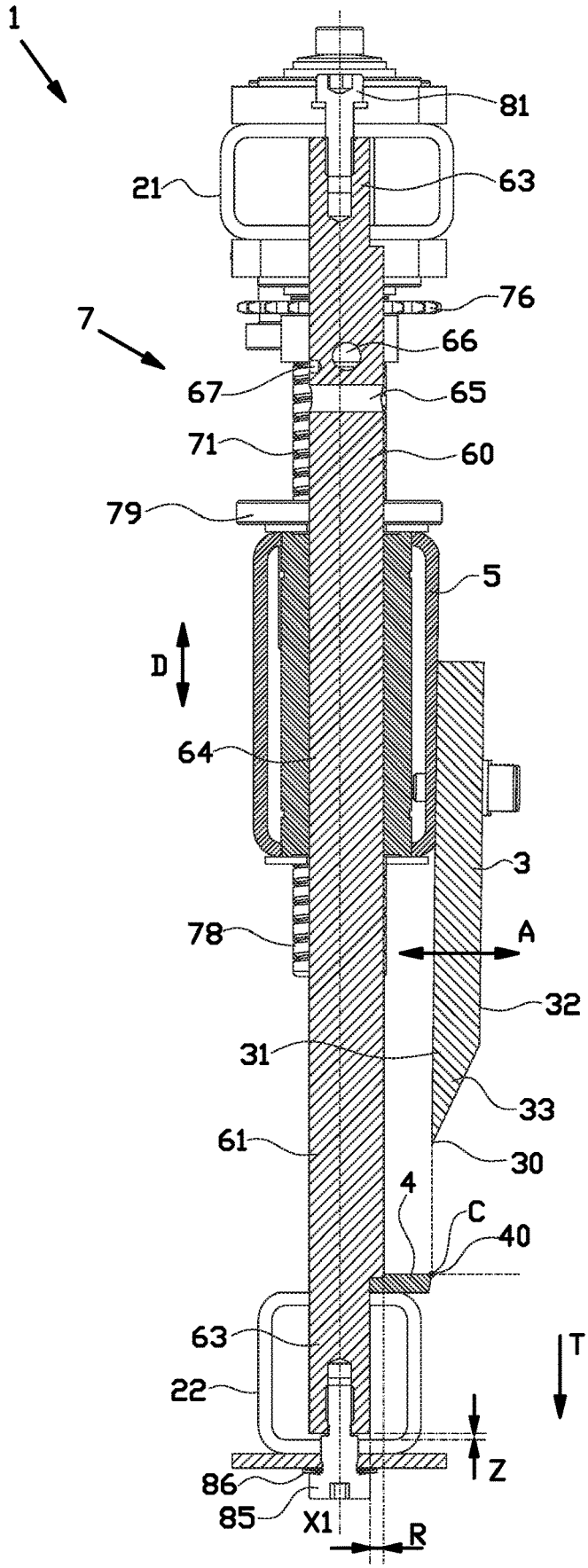
FIG. 6 shows a cross section view of the cutting device according to line VI-VI in FIG. 2.

As best seen in FIG. 6, the cutting blade 3 comprises a flat or substantially flat cutting surface 31 that faces the counter-blade 4 when the cutting blade 3 moves across the cutting line C. The driving direction D is preferably parallel or substantially parallel to said flat cutting surface 31. The cutting blade 3 further has a front surface 32 that tapers towards the cutting surface 31 to form an upper cutting edge 30. Said upper cutting edge 30 is angled at an oblique angle to the cutting line C. As such, the upper cutting edge 30 has a lowest point that is closest to the counter-blade 4 in the driving direction D and a highest point that is further away from the counter-blade 4 in the driving direction D. In this exemplary embodiment, the front surface 32 is beveled to form a sharp chisel grind 33 together with the flat cutting surface 31. It will be apparent to one skilled in the art that other blade configurations are also possible and that the scope of the present invention is not limited to the configuration as shown.

Figure 2:
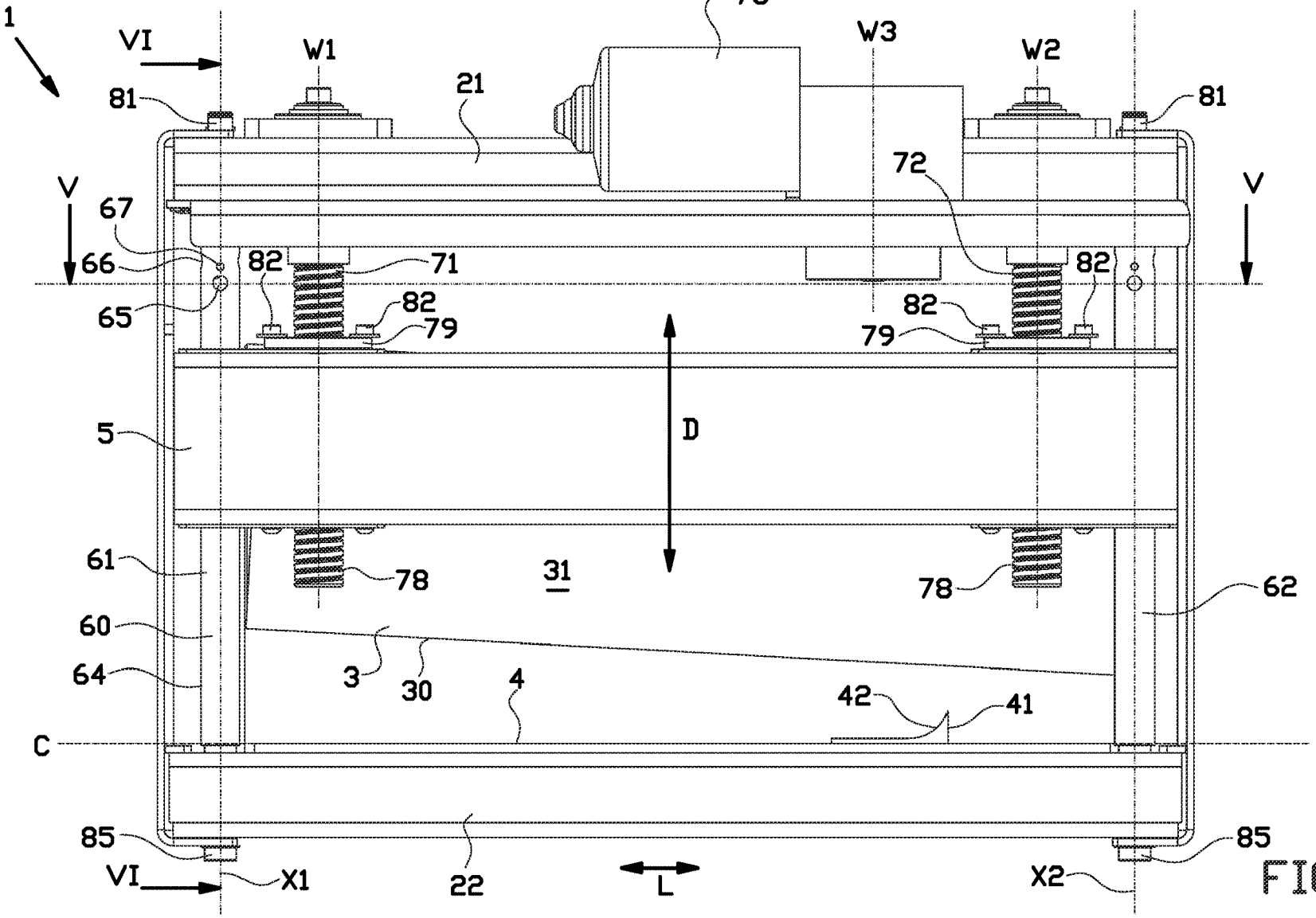
FIG. 2 shows a front view of the cutting device according to FIG. 1.

In this exemplary embodiment, the counter-blade 4 is formed as a rectangular strip that is secured to the frame 2 by bolts or other suitable fasteners at or along the cutting line C in a position opposite to the cutting blade 3. The counter-blade 4 forms a lower cutting edge 40 that extends parallel or substantially parallel to the cutting line C. The counter-blade 4 may be slightly beveled at the cutting edge 40. Optionally, as shown in FIG. 2, the counter-blade 4 may be provided with a support member 41 for supporting the spine 91 of a booklet 90, as schematically shown in FIG. 2. The support member 41 may be an integral part of the counter-blade 4 or may be mounted on the counter blade 4 with suitable fasteners. The support member 41 has a concave support surface 42 that is arranged to closely match and/or support the curvature of the spine 91 in place and thereby improve the cutting quality at said spine 91. In particular, paper snippets may be prevented at the spine 91.

As further shown in FIG. 6, the cutting device 1 comprises a holder 5 for holding the cutting blade 3 relative to the counter-blade 4. In this example, the cutting blade 3 is securely attached to the holder 5 by means of bolts or other suitable fasteners. Preferably, the rear of the surface 31 of the cutting blade 3 is arranged in direct abutment with the holder 5, i.e. without spacing, adjustment or calibration means, to reduce and/or eliminate tolerances between the cutting blade 3 and the holder 5.

Figure 4:
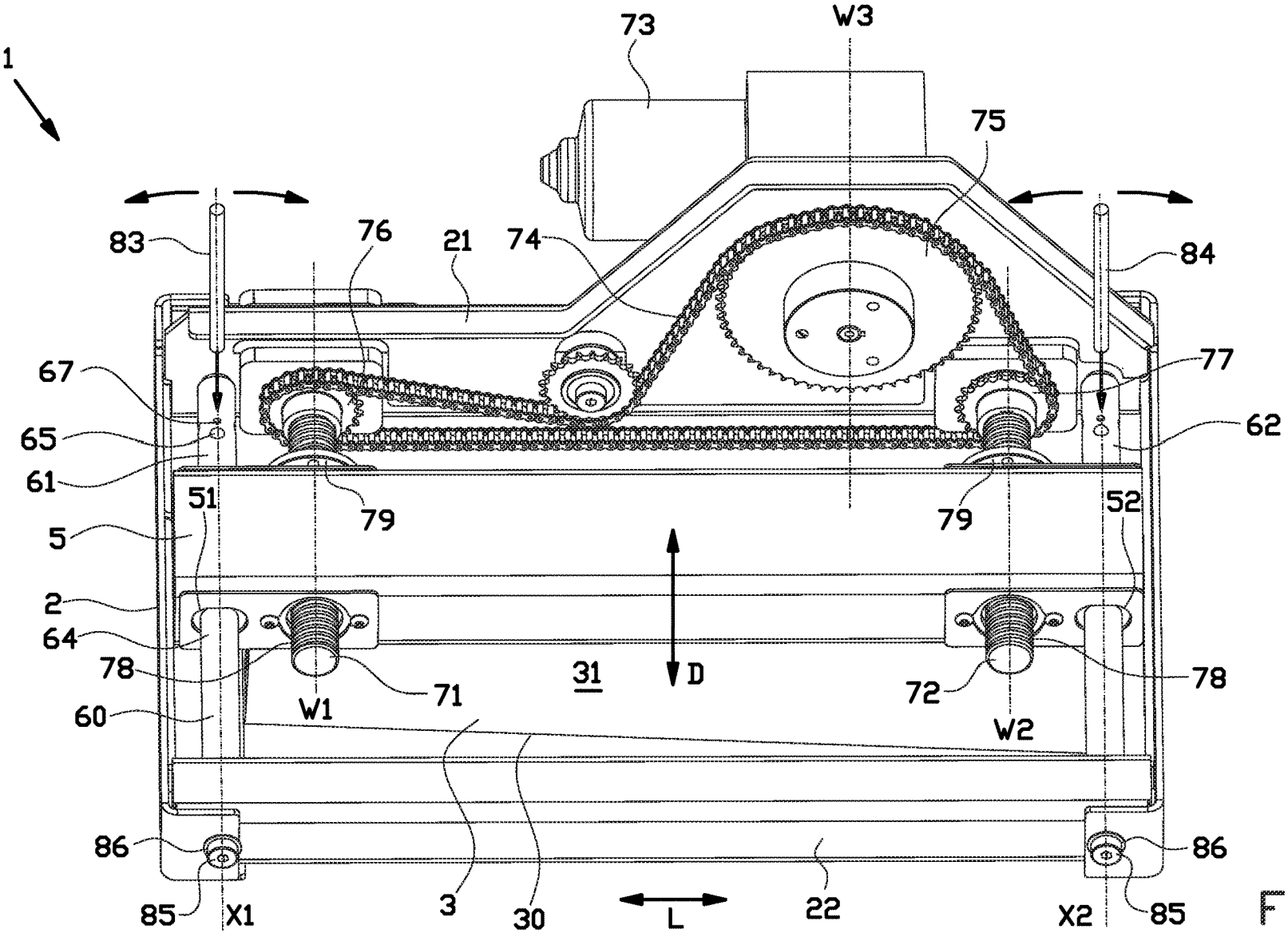
FIG. 4 shows a view from below of the cutting device according to FIG. 1.

As best seen in FIG. 4, the cutting device 1 is provided with one or more guides 61, 62 extending in the driving direction D for linearly guiding the holder 5, with the cutting blade 3 attached thereto, in said driving direction D. In this example, the cutting device 1 comprises a first guide 61 and a second guide 62 which are spaced apart from each other, preferably at opposite ends of the holder 5.

Figure 3:
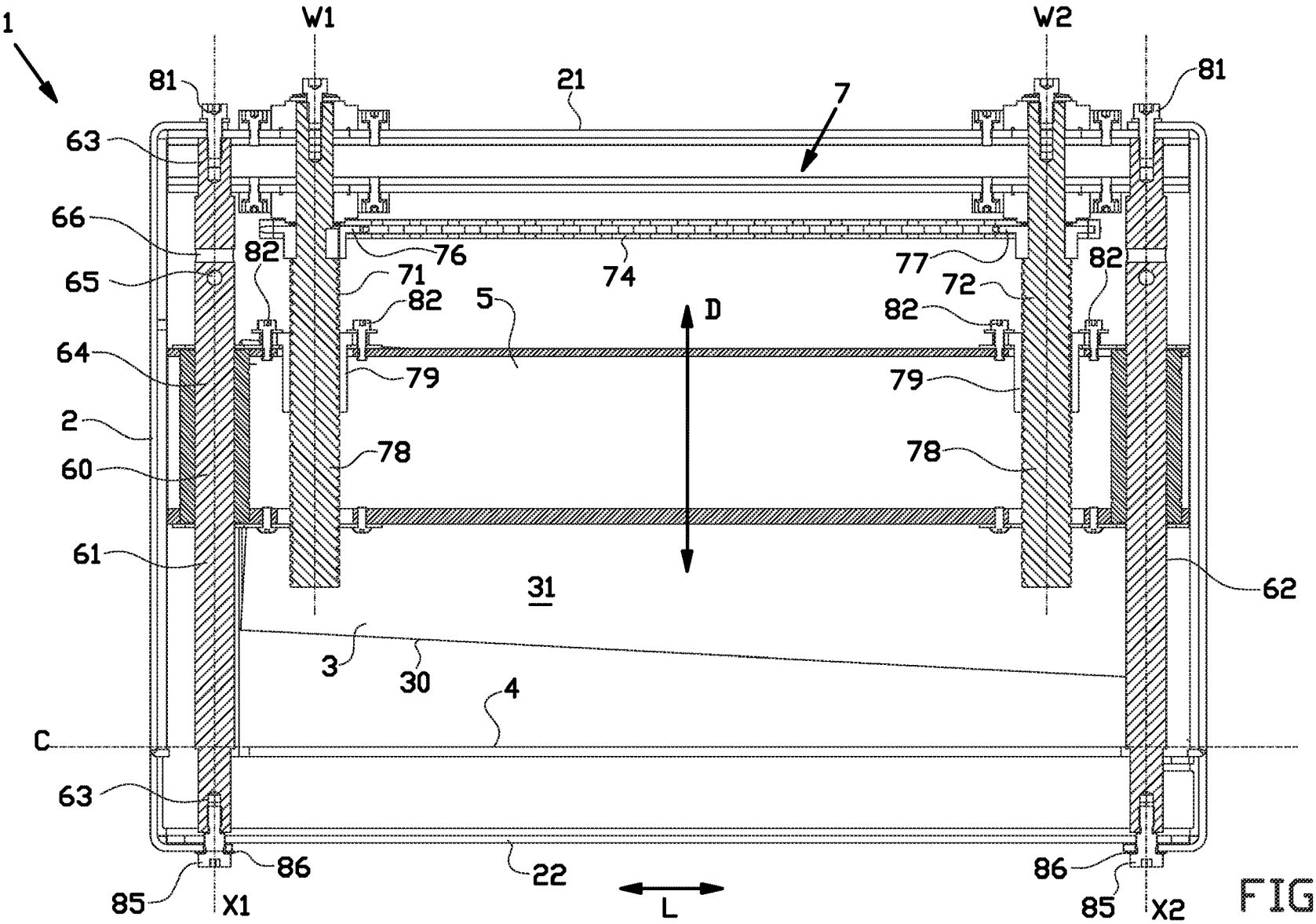
FIG. 3 shows a cross section view of the cutting device according to line III-III in FIG. 1.

In a preferred embodiment of the invention, the one or more guides 61, 62 double as calibration members for calibrating the position of the cutting blade 3 relative to the counter-blade 4. In particular, as shown in FIG. 3, each guide 61, 62 comprises a guide body 60 that extends in the driving direction D between opposite parts of the frame 2, in this example being the upper end 21 and a lower end 22 of the frame 2, respectively. The holder 5 is arranged to be freely slide over or along said guide body 60 in the driving direction D. The cutting device 1 comprises one or more first fixation members 81, or first fixators 81, for fixating the guide bodies 60 of the first guide 61 and the second guide 62 relative to the frame 2. The one or more first fixation members 81 may be bolts, clamps or other suitable fasteners. The one or more first fixation members 81 are arranged for releasing the fixation of the guide bodies 60 relative to the frame 2, i.e. by loosening or unclamping. In this example, the one or more first fixation members 81 are bolts with a hexagonal socket that can be loosened and tightened with the use of a hex key 8, as shown in FIG. 1. When released, the guide body 60 is movable relative to the frame 2 in an adjustment direction A perpendicular to the cutting line C and the driving direction D, thereby displacing the holder 5 and the cutting blade 3 attached thereto relative to the counter-blade 4.

In the exemplary embodiment as shown in FIG. 6, the guide bodies 60 of the first guide 61 and the second guide 62, when released, are arranged to be rotatable relative to the frame 2 about a first adjustment axis X1 and a second adjustment axis X2, respectively. In particular, each guide body 60 comprises one or more concentric sections 63 that connect the guide body 60 concentrically about the respective adjustment axis X1, X2 to the frame 2. In this example, the concentric sections 63 are located at the top and the bottom of the guide body 60 at or near the upper end 21 and the lower end 22 of the frame 2. The guide body 60 is provided with concentrically located, threaded bores at the respective concentric sections 63 for threaded connection to one of the bolt-shaped first fixation members 81. Hence, said one first fixation member 81 concentrically connects to the guide body 60 and/or defines the adjustment axis X1, X2 of the respective guide 61, 62. Preferably, the frame 2 comprises one or more bearing surfaces to concentrically receive the concentric sections 63 and to ensure reliable rotation of said concentric sections 63 about the respective adjustment axis X1, X2 relative to the frame 2.

Each guide body 60 further comprises an eccentric section 64 that is eccentric with respect to the one or more concentric sections 63 and/or the respective adjustment axis X1, X2. As such, each eccentric section 64 is arranged to travel an eccentric path or moves eccentrically about the respective adjustment axis X1, X2 with at least a component in the adjustment direction A. The radii of the eccentric section 64 with respect to the respective adjustment axis X1, X2 vary within a maximum adjustment range R of at least half a millimeter, preferably at least one millimeter and most preferably at least two millimeters. Hence, each eccentric section 64 can effectively cause a displacement in the adjustment direction A within the specified range.

As best seen in FIGS. 5A-5D, the holder 5 is provided with slotted holes 51, 52 through which the eccentric sections 64 of the respective guides 61, 62 are received. The slotted holes 51, 52 are elongated in a lateral direction L perpendicular to the driving direction D and the adjustment direction A to absorb the eccentric movement of the eccentric sections 64 relative to the holder 5 in the lateral direction L and to closely follow the component of the eccentric movement of the eccentric sections 64 in the adjustment direction A. Consequently, the holder 5 moves with the eccentric movement of the eccentric sections 64 in the adjustment direction A only. In other words, the interaction between the slotted holes 51, 52 and the eccentric sections 64 effectively converts the rotational movement of the guides 61, 62 about the respective adjustment axes X1, X2 into a linear movement of the holder 5 in the adjustment direction A.

In this example, as best seen in FIGS. 3 and 4, each guide 61, 62 is provided with one or more tool engagement elements 65, 66 to facilitate engagement of the guide 61, 62, or tool engagers 61, 62, with a tool for rotating the guides 61, 62 about the respective adjustment axes X1, X2 with the use of (manual) tools. In particular, in this example, the one or more tool engagement elements 65, 66 are tool holes 65, 66 for receiving a pin or a lever 83, 84 that facilitates manual rotation of the guides 61, 62. Preferably, each guide 61, 62 comprises two or more tool engagement elements 65, 66 which are offset in a circumferential direction about the guide body 60 to receive or engage the same tool, i.e. the lever 83, 84, in different angular positions around the respective adjustment axis X1, X2. Hence, the lever 83, 84 may be inserted into one of the tool holes 65, 66 even if the other tool hole 65, 66 is rotated out of reach. Alternatively, the guides 61, 62 may be adjusted mechanically by adjustment drives (not shown). The adjustment may even be automated with the use of one or more sensors (not shown) that detect the relative position of the cutting blade 3 with respect to the counter blade 4 as a result of the adjustment.

Optionally, each guide 61, 62 may comprise a reference element 67, i.e. a marking, a recess or a protrusion, that indicates a special position of the respective guide 61, 62. Such a special position may be the position in which the guides 61, 62 position the cutting blade 3 at a distance in which the upper cutting edge 30 and the lower cutting edge 40 are maximally spaced apart from the counter-blade 4 in the adjustment direction A. Note that the maximum spacing between the cutting blade 3 and the counter-blade 4 does not necessarily correspond to the maximum adjustment range R of the guides 61, 62 in the adjustment direction A. Instead, it is preferred to have the cutting blade 3 closer to the counter-blade 4 than said maximum adjustment range R at said maximum spacing, such that the position of the cutting blade 3 can be calibrated relative to the counter-blade 4 within the maximum adjustment range R that overlaps with the counter-blade 4. Consequently, when the cutting blade 3 and/or the counter-blade wear down, part of the maximum adjustment range R remains unused to compensate accordingly. In this example, the upper cutting edge 30 is spaced apart maximally from the lower cutting edge 40 in the adjustment direction A at a distance of approximately half a millimeter. Hence, with a maximum adjustment range R of for example one millimeter, the position of the cutting blade 3 can be adjusted over half a millimeters beyond the counter-blade 4 within the maximum adjustment range R.

As shown in FIGS. 2, 3, 4 and 6, the guides 61, 62 are fixed to the lower end 22 of the frame 2, by suitable fasteners 85, preferably bolts. In this exemplary embodiment, the fasteners 85 fixated against rotation relative to the frame 2 about the respective adjustment axis X1, X2 by a suitable spring 86, e.g. a cupped spring or a disc spring. In particular, the spring 86 tensions the fastener 85 relative to the frame 2 in a tension direction T, parallel to the driving direction D. As shown in FIG. 6, a small clearance Z is provided between the guide body 60 and the lower end 22 of the frame 2 in the driving direction D to allow the respective guide body 60 to be moved relative to the frame 2 in the tension direction T when the one or more first fixation members 81 at the top end 21 of the frame 2 release the fixation of the guide bodies 60 relative to the frame 2. This reduces the tension on the springs 86, which allows the guide bodies 60 to rotate about the respective adjustment axes X1, X2 without the need to manually interact with the fasteners 85 at the lower end 22 of the frame 2.

As shown in FIGS. 3 and 4, the cutting device 1 is provided with a drive mechanism 7 to drive the movement of the cutting blade 3 in the driving direction D towards and away from the counter-blade 4. The drive mechanism 7 comprises a first linear actuator 71 and a second linear actuator 72 extending in or parallel to the driving direction D. The first linear actuator 71 and the second linear actuator 72 are arranged for acting in or parallel to the driving direction D on the holder 5 and/or the cutting blade 3. The drive mechanism 7 is further provided with a motor 73 and a transmission element 74 that connects the motor 73 to the first linear actuator 71 and the second actuator 72. By using a single motor 73 common to or shared by both linear actuators 71, 72, said linear actuators 71, 72 can be mechanically synchronized. In particular, the transmission element 74 can be mechanical, i.e. a chain or a toothed belt, to connect the motor 73 to each of the linear actuators 71, 72 in a fixed ratio which is the same for both linear actuators 71, 72. More in particular, the transmission element 74 is arranged to interconnect the first linear actuator 71 and the second linear actuator 72 in a 1:1 ratio. Hence, the transmission element 74 acts as a synchronization element. Preferably, the drive mechanism 7 comprises a main sprocket wheel 75 that is directly connected to the motor 73 and that drives the chain or belt-like transmission element 74. The drive mechanism 7 further comprises a plurality of idler wheels 76, 77 of the same size that output the rotation of the main sprocket wheel 75 to both linear actuators 71, 72 in an equal ratio.

As shown in FIGS. 2 and 4, the main sprocket wheel 75 and the idler wheels 76, 77 at the spindles 71, 72 are rotatable about wheel axes W1, W2, W3 parallel or substantially parallel to the driving direction D. Hence, the transmission of the rotation of the main sprocket wheel 75 to the idlers wheels 76, 77 can all occur in the same plane, perpendicular to said driving direction D.

Preferably, the main sprocket wheel 75 is connected to the idler wheels 76, 77 in a ratio of at least 2:1, preferably at least 2.5:1 and most preferably at least 3:1.

Preferably, the motor 73 is an electro-motor, in particular an electric servo-motor. Hence, the position of the motor 73 can be very accurately determined and/or controlled.

In this exemplary embodiment, the linear actuators 71, 72 are mechanical linear actuators, in particular spindles. As such, each linear actuator 71, 72 comprises a screw 78 that is arranged to be rotated by the transmission element 74 and a nut 79 that travels linearly along the screw 78 as the screw 78 rotates. The screws 78 of the linear actuators 71, 72 extend parallel to the guides 61, 62 in the driving direction D.

As shown in FIGS. 2-4, the holder 5 is fixed to the linearly moving parts of the linear actuators 71, 72, in this example to the nuts 78, with the use of one or more second fixation members 82, or second fixators 82. The one or more second fixation members 82 may be bolts, clamps or other suitable fasteners. The one or more second fixation members 82 are arranged for releasing the fixation of the holder 5 relative to the nuts 78, i.e. by loosening or unclamping. In this example, the one or more second fixation members 82 are bolts with a hexagonal socket that can be loosened and tightened with the use of the same hex key 8 that is used to loosen and tighten the one or more first fixation members 81 at the guides 61, 62. When released, the holder 5 is movable relative to the nuts 79 in the adjustment direction A to facilitate the aforementioned adjustment of the guides 61, 62 in said adjustment direction A. In particular, it can be observed in figures SA-SD that the holder 5 is movable with respect to the linear actuators 71, 72 in the adjustment direction A within the maximum adjustment range R, as shown in FIG. 6.

A method for cutting paper with the use of the aforementioned cutting device 1 will now be explained with reference to FIGS. 1-6.

When cutting paper, it is important to calibrate the position of the cutting blade 3 with respect to the counter-blade 4. When the cutting blade 3 is too far spaced apart from the counter-blade 4, the paper will not be cut. When the cutting blade 3 is too close to the counter-blade 4, the cutting device 1 may become jammed. Moreover, the cutting blade 3 and the counter-blade 4 preferably are not at a constant distance along the cutting line C. In other words, their upper cutting edge 30 and lower cutting edge 40 should not be parallel. Ideally, the cutting blade 3 is calibrated so that the lowest point of its upper cutting edge 30 is as close as possible to the lower cutting edge 40 of the counter-blade 4, without making contact. In contrast, the highest point of the upper cutting edge 30 should slightly overlap with the lower cutting edge 40 to create a small tension or bias between the cutting blade 3 and the counter-blade 4 during the cutting.

In the prior art cutting devices, calibration required specialized knowledge and above all; time. Calibration took at least half an hour or more, depending on the experience of the calibration technician. With the cutting device 1 according to the present invention, the calibration can be performed within a few minutes.

As shown in FIG. 1, the one or more first fixation members 81 are loosened, i.e. by untightening the bolts with the hex key 8, to release the fixation of guides 61, 62 relative to the frame 2. Additionally, the one or more second fixation members 82 are loosened, i.e. by untightening the bolts with the same or another hex key 8, to release the fixation of the drive mechanism 7, and in particular the nuts 79 thereof, with respect to the holder 5. The holder 5 is now no longer fixated with respect to the guides 61, 62 and the drive mechanism 5. Consequently, the respective positions of the guides 61, 62 can be adjusted and the holder 5, with the cutting blade 3 attached thereto, can freely follow the movement of the guides 61, 62 during said adjustment.

As shown in FIG. 4, a tool is coupled to, insertable in and/or arranged to engage one of the one or more tool engagement elements 65, 66 at one of the guides 61, 62 to adjust the position of said one guide 61, 62. In this example, a first lever 83 is inserted into one of the tool holes 65, 66 at the first guide 61. The same first lever 83 may also be used to engage the one of the tool holes 65, 66 at the second guide 62. Instead, a second lever 84 may be used to adjust the positions of the guides 61, 62 simultaneously. Preferably, the guides 61, 62 are initially moved into a special position, i.e. the position marked by the reference element 67. In said special position the cutting blade 3 is at a distance maximally spaced apart from the counter-blade 4 in the adjustment direction A. Alternatively, the calibration may be initiated from any position, i.e. the current position of the cutting blade 3.

Now, the calibration may start in accordance with the steps as described below and as shown in FIGS. 5A-5D.

Figure 5A:
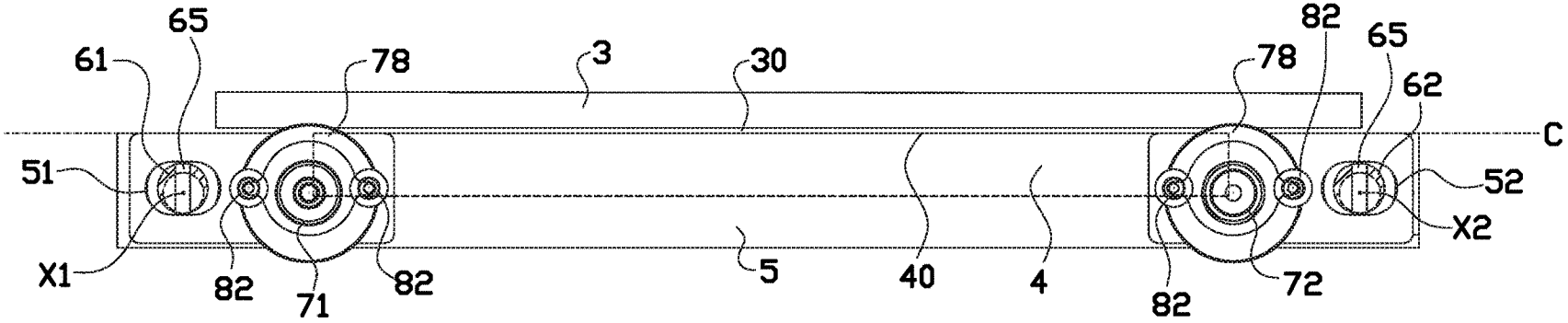
FIG. 5A-5D shows a cross section views of the cutting device according to line V-V in FIG. 2.
Figure 5B:
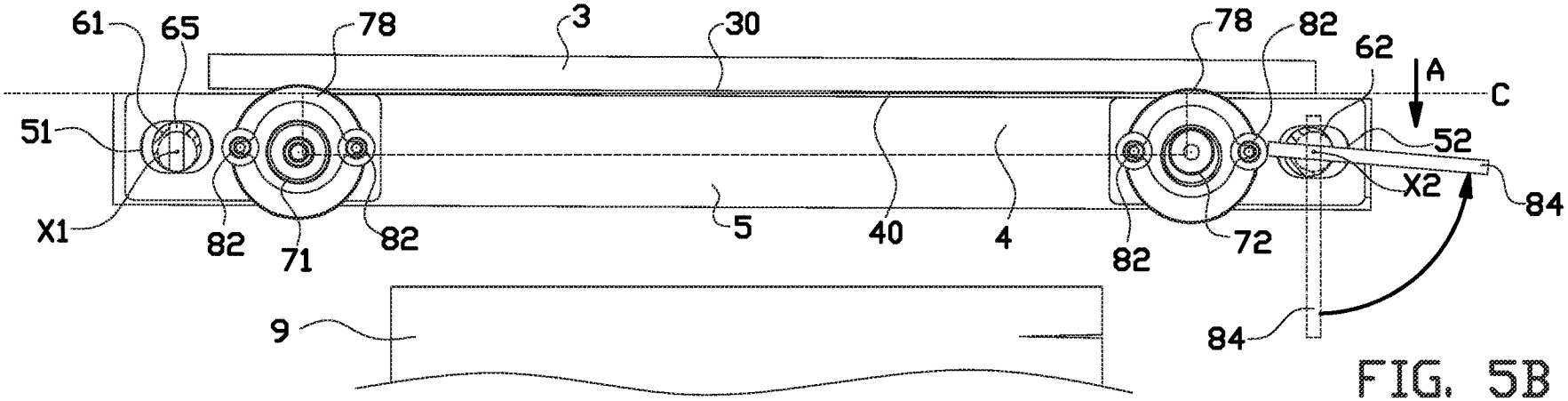

FIG. 5A shows the situation with the guides 61, 62 in a position in which the cutting blade 3 is maximally spaced apart from the counter-blade 4. FIG. 5B shows the situation in which the position of the lowest end of the upper cutting edge 30 is adjusted towards the lower cutting edge 40 by turning the second guide 62 clockwise or counter-clockwise about the second adjustment axis X2. Based on experience, the calibration technician may already know the amount of rotation required to approximate the optimal position of the second guide 62. Alternatively, small increments may be used. Between each increment, the calibration technician may perform a cutting stroke on a single sheet of paper 9 to check if said single sheet of paper 9 is already being cutting by the lowest end of the upper cutting edge 30. As soon as the upper cutting edge 30 starts to cut the paper 9 at the lowest end, as shown in FIG. 5B, the second guide 62 is in position and should no longer be adjusted. Preferably, the one or more first fixation members 81 associated with the second guide 62 may be tightened or fastened again with suitable tools to fix the position of the second guide 62 relative to the frame 2.

Figure 5C:
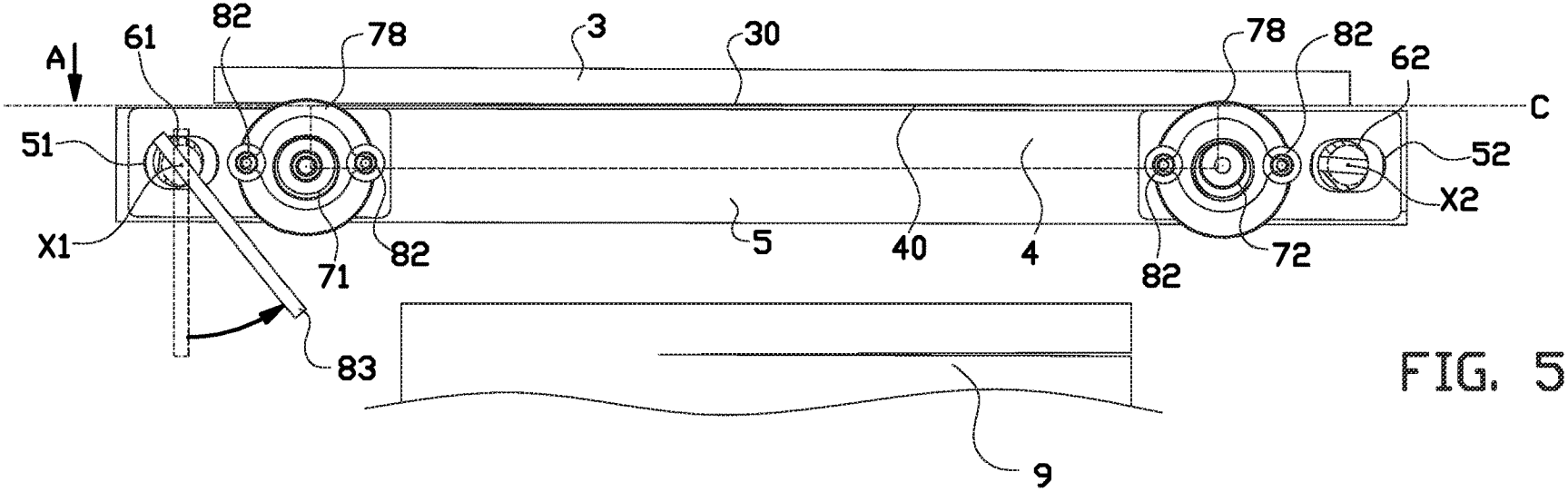
Figure 5D:
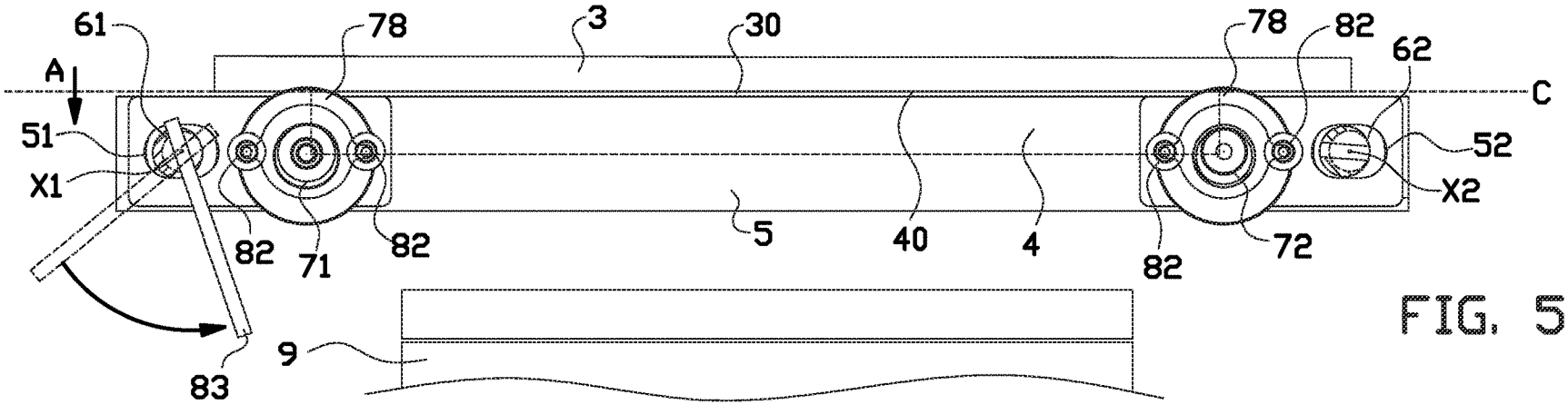

FIG. 5C shows the situation in which the calibration technician has started to adjust the position of the first guide 61. Again, based on experience, the calibration technician may already know the amount of rotation required to approximate the optimal position of the first guide 61. Alternatively, small increments may be used. Between each increment, the calibration technician may perform a cutting stroke to check if the paper 9 is already being cutting by the highest end of the upper cutting edge 30. With each increment, the cut in the paper 9 will progressively increase in length until the upper cutting edge 30 cuts along the cutting line C across the entire width of the paper 9. FIG. 5C shows the situation in which the paper 9 is only cut half-way across the width. FIG. 5D shows the situation in which the paper 9 is cut completely, which is an indicator that the first guide 61 is now properly positioned and/or that the upper cutting edge 30 is properly calibrated with respect to the lower cutting edge 40. When the first guide 61 is properly positioned, the one or more first fixation members 81 associated with the first guide 61 may be tightened or fastened again with suitable tools to fix the position of the first guide 61 relative to the frame 2.

Optionally, the calibration technician may perform an additional check in which a stack of paper 90, as for example shown in FIG. 1, is cut. The stack of paper 90 may cause some deburring at the cutting edges 30, 40 that may have a negative impact on the cutting quality. After the stack of paper 90 has been cut successfully, the calibration technician again cuts a single sheet of paper 9 to see if said single sheet of paper 9 is still cut consistently. If not, the abovementioned calibration steps are repeated.

Finally, the one or more second fixation members 82 are tightened or fastened with suitable tools to fixate the position of the drive mechanism 7 with respect to the holder 5 in its newly calibrated position. The cutting device 1 according to the invention is now calibrated and ready for cutting.

When cutting through a stack of paper 90, as shown in FIG. 1, the cutting blade 3 is subjected to a load travelling along its obliquely angled upper cutting edge 30. This causes uneven loads on the linear actuators 71, 72. However, the transmission element 74 as shown in FIG. 4 ensures that both linear actuators 71, 72 are driven at the same speed, thereby synchronizing their operation. Hence, skewing, misalignment and/or tension between the cutting blade 3, the linear actuators 71, 72 and/or the guides 61, 62 can be reduced or even prevented.

Figure 7:
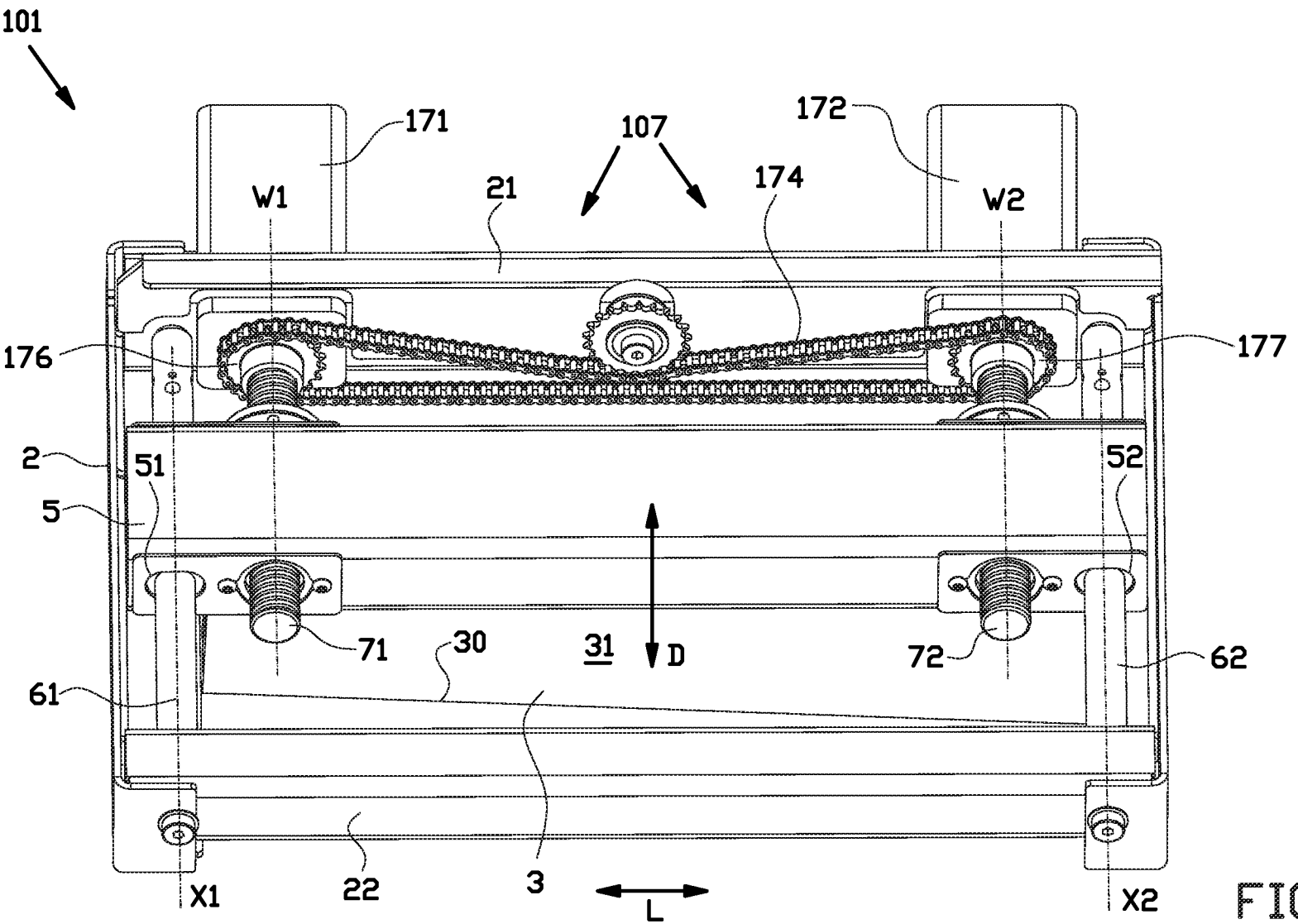
FIG. 7 shows a view from below of an alternative cutting device for cutting paper according to a second embodiment of the invention.

FIG. 7 shows an alternative cutting device 101 according to a second exemplary embodiment of the invention. The alternative cutting device 101 differs from the previously discussed cutting device 1 in that it features an alternative drive mechanism 107 with a first motor 171 and a second motor 172 for driving the movement of the first linear actuator 71 and the second linear actuator 72, respectively, in the driving direction D. Consequently, each linear actuator 71, 72 has its own motor 171, 172. The linear actuators 71, 72 may therefore be driven directly. The alternative drive mechanism 107 further comprises a mechanical synchronization element 174 to synchronize the linear actuators 71, 72. In particular, the mechanical synchronization element 174 is arranged to interconnect the first linear actuator 71 and the second linear actuator 72 in a 1:1 ratio. In this example, the synchronization element 174 is a chain or a toothed belt. The chain or toothed belt engages with idler wheels 176, 177 at the respective linear actuators 71 72 and interconnects said idler wheels 176, 177 in a 1:1 ratio. In this manner, the synchronization element 174 can prevent that one of the linear actuators 71, 72 rotates faster than the other, i.e. as a result of uneven loads on the cutting blade 3.

Figure 8:
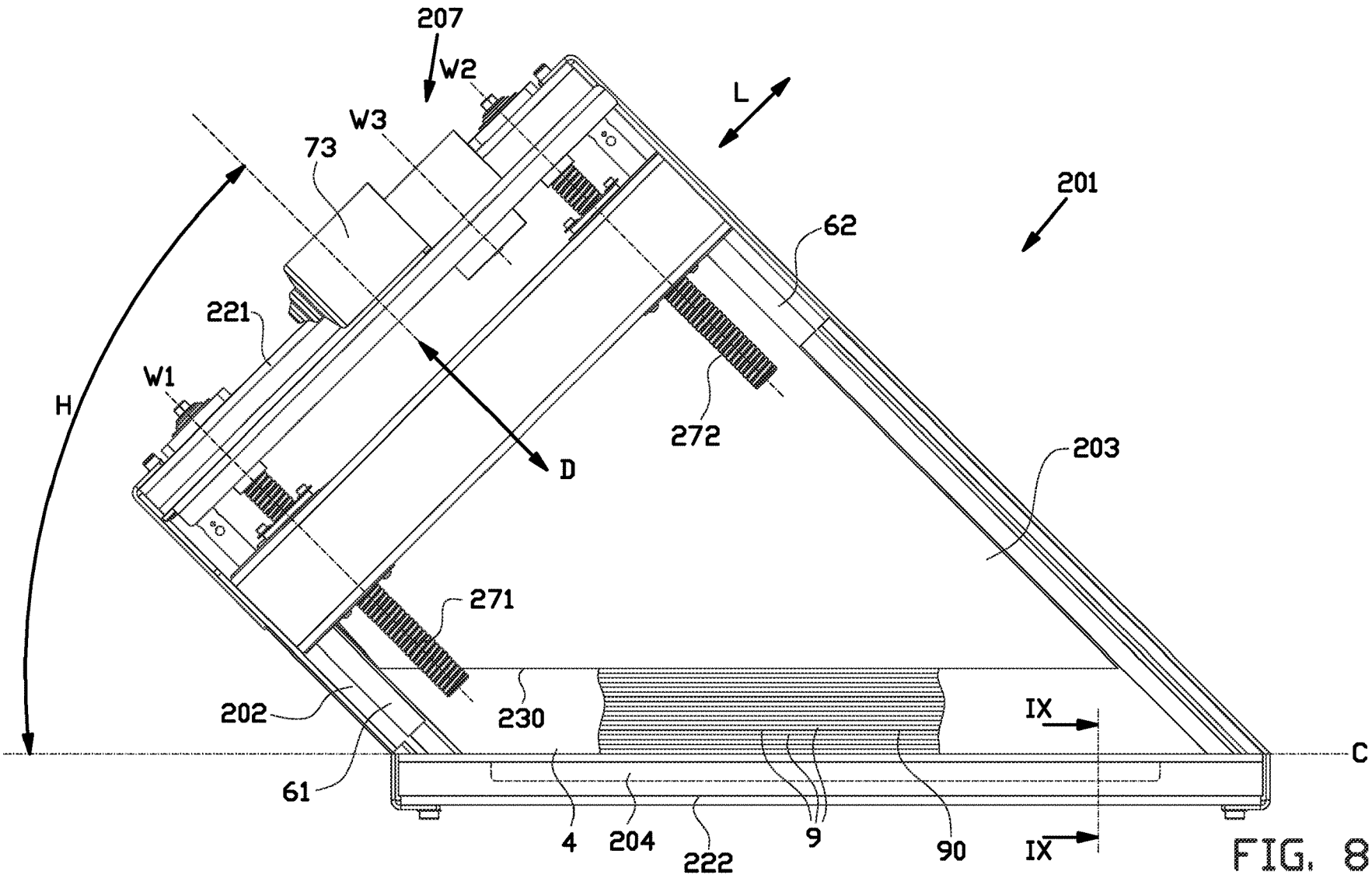
FIG. 8 shows a front view of a further alternative cutting device for cutting paper according to a third embodiment of the invention.
Figure 9:
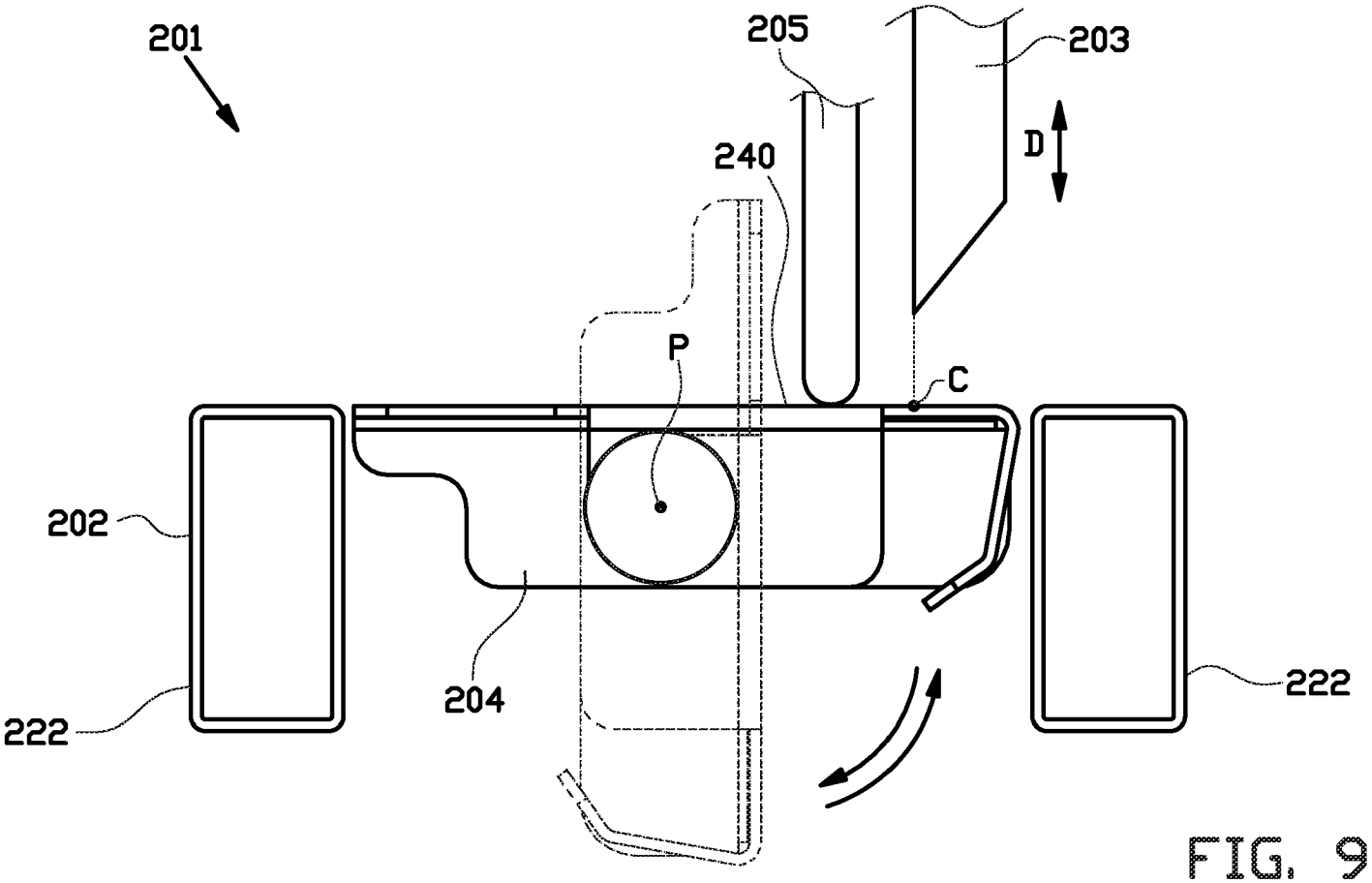
FIG. 9 shows a cross section view of the alternative cutting device according to the line IX-IX in FIG. 8.
Figure 10:
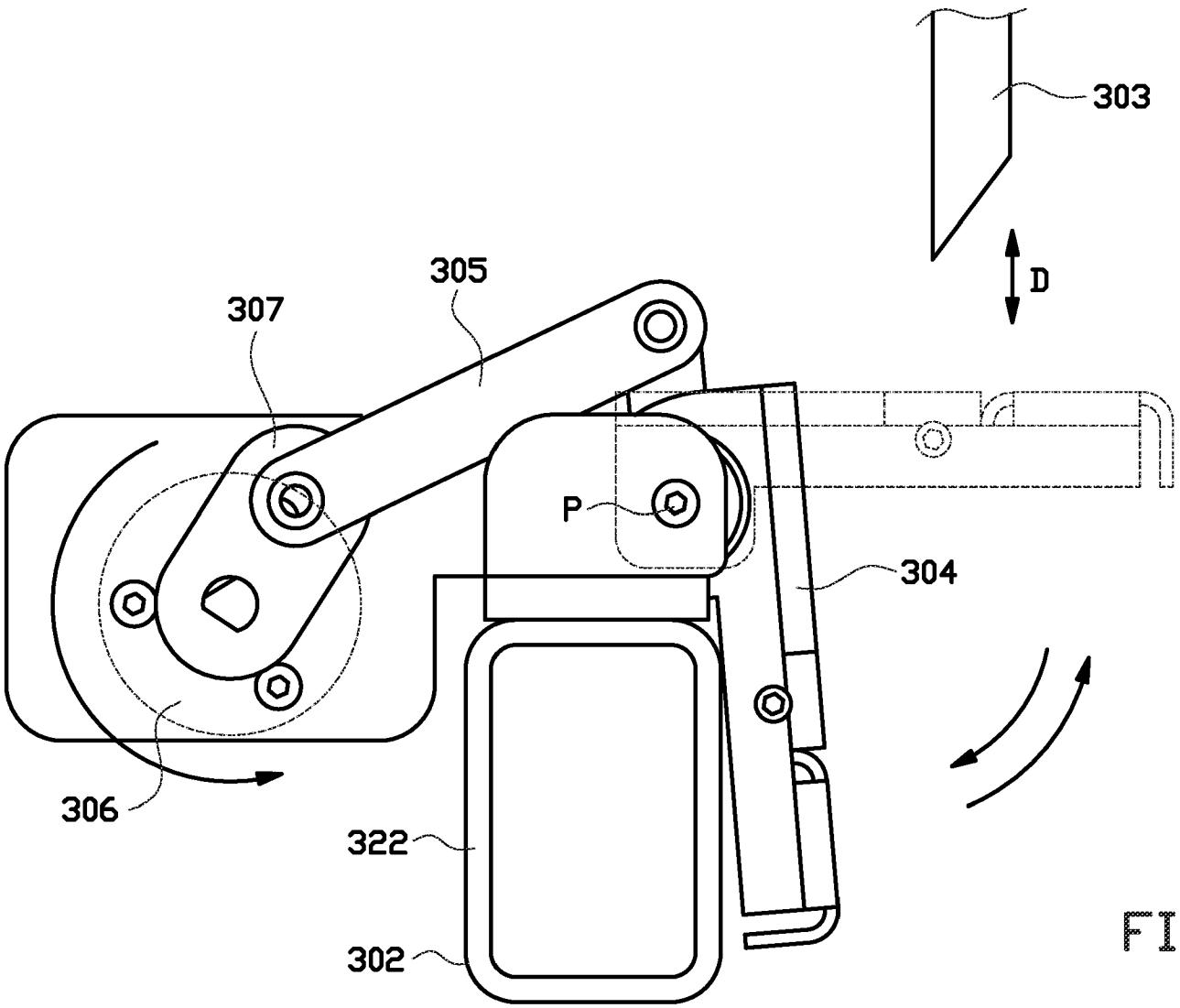
FIG. 10 shows a cross section view of a further alternative cutting device according to a fourth embodiment of the invention.

FIG. 8 shows a further alternative cutting device 201 according to a third exemplary embodiment of the invention. The further alternative cutting device 201 differs from the previously discussed cutting device 1, 101 in that its driving direction D extends obliquely or transverse to the cutting line C. In particular, the alternative driving direction D as shown in FIG. 8 is at an angle H in a range of thirty to eighty degrees with respect to the cutting line C, more preferably in a range of forty to sixty degrees and most preferably at an angle H of approximately forty-five degrees.

The further alternative cutting device 201 further differs from the previously discussed cutting devices 1, 101 in that it features an alternative cutting blade 203 and counter-member 204 configuration. While the counter-member 204 is still supported in a substantially level or horizontal orientation and supports the paper 9 along a substantially level or horizontal cutting line C, the alternative cutting blade 203 moves at the oblique driving direction D towards the counter-member 204 and has an upper cutting edge 230 that extends parallel or substantially parallel to the cutting line C.

As a result of the oblique driving direction D, the alternative cutting blade 203 travels towards the cutting line C with a component in the vertical direction and a component in the horizontal direction, parallel to the cutting line C. The upper cutting edge 230 thus makes a sawing movement through the stack of paper 90 rather than a vertical guillotine cutting movement. This allows the alternative cutting blade 203 to saw through thicker stacks of paper 90.

To accommodate the alternative cutting blade 203 moving at the oblique driving direction D, an alternative frame 202 is provided with an upper end 221 that is angled to match the oblique driving direction D and a lower end 222 that supports the counter-member 204 at the cutting line C. The further alternative cutting device 201 is provided with an alternative drive mechanism 207 that has linear actuators 271, 272 arranged at the same angle H to the cutting line C as the oblique driving direction D. In other words, the linear actuators 271, 272 are arranged to act in or parallel to the oblique driving direction D. Apart from the orientation, the alternative drive mechanism 207 may function similarly to the drive mechanisms 7, 107 of the previous embodiments of the invention.

Note that one side of the frame 202 is now considerably longer than the other side. The guides 61, 62 may remain the same length as in the previous embodiments of the invention, as they only need to provide guidance at the location of the holder 5. Optionally, the length of the linear actuators 271, 272 may be increased to increase the length of the cutting stroke. The length of the guides 61, 62 may be increased accordingly. Hence, the thickness of the stacks of paper 90 that can be cut is in principle only limited by the geometrical limitations of the available space.

The combination of the oblique driving direction D and the linear actuators 271, 272 acting in or parallel to said oblique driving direction D results in a sawing action during which the load on the alternative cutting blade 230 remains substantially constant at any depth during the cutting, regardless of the thickness of the stack of paper 90 that is being cut. Hence, the maximum thickness of stacks of paper that can be cut is in principle limitless.

In this alternative embodiment, the counter-member 204 forms a flat counter-surface 240 at the cutting line C that cooperates with the alternative cutting blade 203 to cut the paper 9. The cutting process may leave snippets of paper 9 or other paper residue on the counter-surface 240. In conventional cutting devices, these paper snippets have to be removed manually. In the present invention, the counter-member 204 is pivotable relative to the lower end 222 of the frame 202 about a pivot axis P to drop the paper snippets from the counter-surface 240, i.e. into a waste bin below the cutting device 201. The pivoting may be user-activated or automatically activated after a predetermined number of cuts. The automatic activation may be performed by a pushing member 205, i.e. a mechanical finger, that pushes down on the counter surface 240 at the same side of the pivot axis P as the cutting line C to force the counter-member 204 into a drop position.

Alternatively, as shown in a further alternative cutting device according to a fourth embodiment of the invention, the counter-member 304 may be driven in rotation about the pivot axis P by a drive 306, i.e. a servo-motor. Also in this case, the counter-member 304 is pivotable relative to the lower end 322 of the frame 302 about a pivot axis P to move into an active position (shown in dashed lines) and a drop position (shown in solid lines) relative to the cutting blade 303. In this particular example, the transmission from the drive 306 to the counter-member 304 is an eccentric drive comprising a crank shaft 307 that is driven in rotation by the drive 306 and an arm or a finger 305 driven by said crank shaft 307. The finger 305 is connected to the counter-member 304 at a distance from the pivot axis P so that it may act as a lever on the counter-member 304.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A cutting device for cutting paper, the cutting device comprising:

a cutting blade and a counter-member that cooperate to cut the paper along a cutting line, and a frame, wherein the cutting blade is movable relative to said frame towards and away from the counter-member in a driving direction, transverse or perpendicular to the cutting line, for cutting the paper, wherein the cutting device further comprises a holder that holds the cutting blade relative to the counter-member, wherein the cutting device is further provided with a first guide and a second guide extending in or parallel to the driving direction that linearly guide the holder, wherein the cutting device further comprises one or more first fixators that fixate at least the first guide relative to the frame, wherein the one or more first fixators are arranged to release the fixation of the first guide relative to the frame, wherein the first guide, when released, is movable relative to the frame in an adjustment direction perpendicular to the cutting line and the driving direction, wherein each of the first guide and the second guide respectively comprises a guide body, wherein the guide bodies of the first guide and the second guide, when released, are arranged to be rotatable relative to the frame about a first adjustment axis and a second adjustment axis, respectively, wherein each of the guide bodies comprises an eccentric section that moves eccentrically about the respective adjustment axis and that is arranged to convert the rotational movement of the respective first and second guides about the respective adjustment axes into a linear movement of the holder in the adjustment direction, and wherein the holder is provided with slotted holes through which the eccentric sections of the respective first and second guides are received, wherein the slotted holes are elongated in a lateral direction perpendicular to the driving direction and the adjustment direction to convert the eccentric movement of the eccentric sections relative to the holder in the lateral direction into a linear movement of the holder that follows the eccentric movement of the eccentric sections in the adjustment direction.

2. The cutting device according to claim 1, wherein the one or more first fixators are arranged to release the fixation of the second guide relative to the frame, wherein the second guide, when released, is movable relative to the frame in the adjustment direction.

3. The cutting device according to claim 1, wherein the holder is arranged to slide over or along the first guide and the second guide in the driving direction.

4. The cutting device according to claim 1, wherein the eccentric sections of the first guide and the second guide have varying radii with respect to the first adjustment axis and the second adjust axis respectively, wherein the radii vary within a maximum adjustment range of at least half a millimeter.

5. The cutting device according to claim 1, wherein each of the first guide and the second guide comprises a reference element that indicates a special position of the respective guide.

6. The cutting device according to claim 1, wherein the one or more first fixators are located at a top end of the frame, wherein the first and second guides are fixed to a lower end of the frame by fasteners, wherein the fasteners are fixated against rotation relative to the frame about the respective adjustment axis by the tension of a spring acting in a tension direction parallel to the driving direction, wherein the cutting device is provided with a clearance between the guide bodies and the lower end of the frame to allow the guide bodies to move in the tension direction when released by the one or more first fixators at the top end.

7. The cutting device according to claim 1, wherein the one or more first fixators comprises a bolt.

8. The cutting device according to claim 1, wherein the cutting device is provided with a drive mechanism to drive the movement of the cutting blade with respect to the counter-member in the driving direction, wherein the drive mechanism comprises a first linear actuator and a second linear actuator which are arranged to act on the holder in or parallel to the driving direction.

9. The cutting device according to claim 1, wherein the cutting blade comprises a flat cutting surface, wherein the driving direction is parallel to said flat cutting surface.

10. A method for cutting paper with the cutting device according to claim 1, wherein the method comprises:

calibrating the cutting blade with respect to the counter-member, wherein the calibrating of the cutting blade comprises the steps of using the one or more first fixators to release the fixation of the first guide relative to the frame and moving the first guide relative to the frame in the adjustment direction.

11. The method according to claim 10, wherein the calibration further comprises the steps of using the one or more first fixators to release the fixation of the second guide relative to the frame and moving the second guide relative to the frame in the adjustment direction.

12. The method according to claim 10, wherein the first guide or the second guide are moved over increments, wherein the calibrating of the cutting blade further comprises the step of performing a cutting stroke between the increments to check if the paper is being cut.

13. The method according to claim 12, further comprising initially calibrating the cutting blade by cutting and assessing a quality of a cut in a single sheet of paper, wherein, when the step of initially calibrating the cutting blade based on the single sheet of paper has been completed, the method further comprises the step of cutting a stack of paper and then again cutting a single sheet of paper.

14. The method according to claim 10, wherein the cutting blade comprises a flat cutting surface, wherein the driving direction is parallel to said flat cutting surface.

15. A cutting device for cutting paper, the cutting device comprising:

a cutting blade and a counter-member that cooperate to cut the paper along a cutting line, and a frame, wherein the cutting blade is movable relative to said frame towards and away from the counter-member in a driving direction, transverse or perpendicular to the cutting line, for cutting the paper, wherein the cutting device further comprises a holder that holds the cutting blade relative to the counter-member, wherein the cutting device is further provided with a first guide and a second guide extending in or parallel to the driving direction that linearly guide the holder, wherein the cutting device further comprises one or more first fixators that fixate at least the first guide relative to the frame, wherein the one or more first fixators are arranged to release the fixation of the first guide relative to the frame, wherein the first guide, when released, is movable relative to the frame in an adjustment direction perpendicular to the cutting line and the driving direction, wherein each of the first guide and the second guide respectively comprises a guide body, wherein the guide bodies of the first guide and the second guide, when released, are arranged to be rotatable relative to the frame about a first adjustment axis and a second adjustment axis, respectively, wherein each of the guide bodies comprises an eccentric section that moves eccentrically about the respective adjustment axis and that is arranged to convert the rotational movement of the respective first and second guides about the respective adjustment axes into a linear movement of the holder in the adjustment direction, and wherein each of the first guide and the second guide is provided with one or more tool engager that facilitate engagement of the guide with a tool to the guide about the respective adjustment axis.

16. The cutting device according to claim 15, wherein the one or more tool engager are tool holes that receive a lever that facilitates manual rotation of the first and second guides.

17. The cutting device according to claim 15, wherein each of the first guide and the second guide comprises two or more tool engager which are offset in a circumferential direction about the guide body.

18. A cutting device for cutting paper, the cutting device comprising:

a cutting blade and a counter-member that cooperate to cut the paper along a cutting line, and a frame, wherein the cutting blade is movable relative to said frame towards and away from the counter-member in a driving direction, transverse or perpendicular to the cutting line, for cutting the paper, wherein the cutting device further comprises a holder that holds the cutting blade relative to the counter-member, wherein the cutting device is further provided with a first guide and a second guide extending in or parallel to the driving direction that linearly guide the holder, wherein the cutting device further comprises one or more first fixators that fixate at least the first guide relative to the frame, wherein the one or more first fixators are arranged to release the fixation of the first guide relative to the frame, wherein the first guide, when released, is movable relative to the frame in an adjustment direction perpendicular to the cutting line and the driving direction, wherein each of the first guide and the second guide respectively comprises a guide body, wherein the guide bodies of the first guide and the second guide, when released, are arranged to be rotatable relative to the frame about a first adjustment axis and a second adjustment axis, respectively, wherein each of the guide bodies comprises an eccentric section that moves eccentrically about the respective adjustment axis and that is arranged to convert the rotational movement of the respective first and second guides about the respective adjustment axes into a linear movement of the holder in the adjustment direction, and wherein the cutting device is provided with a drive mechanism to drive the movement of the cutting blade with respect to the counter-member in the driving direction, wherein the drive mechanism comprises a first linear actuator and a second linear actuator which are arranged to act on the holder in or parallel to the driving direction, wherein the cutting device comprises one or more second fixators that fixate the holder to the linearly moving parts of the linear actuators, wherein the one or more second fixators are arranged to release the holder from said fixation, wherein the holder, when released, is movable relative to the linear actuators in the adjustment direction.

19. The cutting device according to claim 18, wherein each of the linear actuators comprises a rotatable screw and a nut that is arranged to travel linearly along the screw, wherein the one or more second fixators are arranged to fixate the holder to and releasing the holder from the nuts of the linear actuators.

20. The cutting device according to claim 18, wherein the holder is movable with respect to the linear actuators in the adjustment direction within a maximum adjustment range of at least half a millimeter.

* * * * *